US011001902B2

(12) United States Patent
Bertkau et al.

(10) Patent No.: US 11,001,902 B2
(45) Date of Patent: May 11, 2021

(54) PRODUCTION OF LEATHER

(71) Applicant: BASF SE, Ludwigshafen (DE)

(72) Inventors: Walter Bertkau, Ludwigshafen (DE); Yu Mei, Mannheim (DE); Robert Orth, Ludwigshafen (DE); Thomas Schneider, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/767,399

(22) PCT Filed: Feb. 12, 2014

(86) PCT No.: PCT/EP2014/052691
§ 371 (c)(1),
(2) Date: Aug. 12, 2015

(87) PCT Pub. No.: WO2014/124951
PCT Pub. Date: Aug. 21, 2014

(65) Prior Publication Data

US 2015/0376726 A1 Dec. 31, 2015

(30) Foreign Application Priority Data

Feb. 14, 2013 (EP) ..... 13155256

(51) Int. Cl.
*C14C 1/08* (2006.01)
*C14C 3/06* (2006.01)
*C14C 9/02* (2006.01)

(52) U.S. Cl.
CPC ..... *C14C 1/08* (2013.01); *C14C 3/06* (2013.01); *C14C 9/02* (2013.01)

(58) Field of Classification Search
CPC .. C14C 1/00; C14C 11/00; C14C 1/08; C14C 3/06; C14C 9/02
USPC ..... 8/94.21
See application file for complete search history.

(56) References Cited

U.S. PATENT DOCUMENTS 2,122,125 A * 6/1938 Alles ..... C14C 3/20 528/150
2,318,454 A * 5/1943 Bertsch ..... C14C 1/08 8/94.17
3,053,697 A * 9/1962 Mauthe ..... C14C 9/00 427/369
3,939,040 A * 2/1976 Monsheimer ..... C14C 1/08 435/265
5,340,365 A * 8/1994 Wehling ..... C14C 1/08 8/94.18
5,427,594 A * 6/1995 Lauton ..... C14C 1/08 252/8.57
5,820,634 A * 10/1998 Traubel ..... C14C 3/18 8/94.18
6,207,780 B1 * 3/2001 Stockhausen ..... C08F 220/04 510/276
6,254,644 B1 * 7/2001 Traubel ..... C08G 18/8083 428/473
6,777,219 B2 * 8/2004 Laxman ..... C12N 9/58 435/223
7,186,546 B2 * 3/2007 Laxman ..... C12N 9/58 435/223
7,410,504 B2 * 8/2008 Hueffer ..... C07D 307/32 568/483
2006/0130241 A1 * 6/2006 Huffer et al. ..... 8/94.15
2006/0185094 A1 * 8/2006 Brinkmann et al. ..... 8/94.21
2007/0037934 A1 * 2/2007 Kluglein ..... C08F 267/00 525/333.3
2011/0078862 A1 * 4/2011 Kashiwagura ..... C09D 175/04 8/94.21
2019/0309378 A1 * 10/2019 Shi ..... C14C 3/06

FOREIGN PATENT DOCUMENTS

EP 0 563 139 10/1993
WO WO1992011391 A1 * 7/1992 ..... C14C 3/00
WO WO9211391 * 9/1992

OTHER PUBLICATIONS

LTFAI (9.15 Leather Tanning, Food and Agricultural Industry Jun. 1997) pp. 1-5.*
Tanneries, pp. 1-8, Nov. 1976.*
NIH, NLM Pubchem Methanesulfonic acid, pp. 1-22, Sep. 2004.*
Patent Translation of WO9211391pp. 1-13 Jul. 9, 1992.*
Google Patents translation of WO1992011391A1 pp. 1-7. (Year: 2018).*
EPO translation of WO1992011391A1 pp. 1-12. (Year: 2018).*
Wikipedia tanning leather pp. 1-7. (Year: 2019).*
Compilation of Air Pollutant Emission Factors_ Jan. 1995_ vol. I_ Stationary Point and Area Sources_ Chapter 9_ Food and Agricultural Industries, Section 9.15 "Leather Tanning" pp. 1-5 (Year: 1997).*
International Search Report dated Apr. 23, 2014 in PCT/EP2014/052691.

* cited by examiner

*Primary Examiner* — Gregory R Delcotto
*Assistant Examiner* — Preeti Kumar
(74) *Attorney, Agent, or Firm* — Arent Fox LLP

(57) ABSTRACT

In a method of producing leather comprising a plurality of steps, methanesulfonic acid is used in at least one step.

9 Claims, No Drawings

PRODUCTION OF LEATHER

The present invention relates to a method of producing leather comprising a plurality of steps, wherein methanesulfonic acid is used in at least one step.

Leather is one of the oldest materials, yet in the current day and age is still expected to meet very high requirements with regard to durability and visual and haptic properties among others.

Processes for producing leather generally comprise a multiplicity of steps. Multiple steps of leather production are carried out in an aqueous medium at a specified pH. It is very important for this to be the optimum pH because of its influence on the leather obtained.

Particularly the choice of a suitable acid to neutralize the leather after a preceding operation in an alkaline medium has a distinct influence on the quality of the leather obtained. This is the case in the deliming step, for example.

Usage of an excessively strong acid, for example, can have an adverse influence on the visual and physical properties of the leather, possibly because the untreated hides swell up excessively. The choice of an excessively weak acid can have the effect that the pH is slow to become established or that the acid or other substances needed to produce the leather do not completely penetrate the untreated hide. The pH aside, the properties of leather are all influenced by the chemicals used and the production process in a way which is not always predictable.

Conventional methods of producing leather employ, for example, approximately 1% lactic acid, dilute acetic acid, formic acid or other organic acids in the deliming step to dissolve out the adherent liming-step lime residues before the actual tanning. Suitable acids further include, for example, ammonium salts such as ammonium sulfate or ammonium chloride, boric acid, phosphoric acid or carbonic acid. Use of hydrochloric acid or sulfuric acid is likewise possible. Usage of these acids in leather production is well known to a person skilled in the art and is described, for example, in Römpp's Chemie Lexikon under the headword Gerberei [tannage]. Pickling brings the pelt to the correct acidity for a subsequent mineral tannage, usually with inorganic acids and brine, optionally also with additions of organic acids.

EP 563 139 describes the use of methanesulfonic acid for pickling leather.

The problem addressed by the present invention was that of providing a method of producing leather without the disadvantages of the prior art in that it produces soft and attractive leathers and is efficient in practice.

The problem was solved by a method of producing leather comprising a plurality of steps, wherein methanesulfonic acid was used in at least one step.

The method of the present invention proceeds in practice from animal hides or part-processed hides. Animal hides can come from any desired dead animals, for example from cattle, calves, pigs, goats, sheep, kangaroos, fish, ostriches or wild animals. It is immaterial for the purposes of the present invention whether the animals whose hides are desired to be treated were slaughtered, hunted or died of natural causes.

Processes for producing leather generally comprise a multiplicity of steps. In the unhairing step, the hair is removed from the animal hide. This step is also known as the liming step. To unhair the animal hide, it is generally treated with alkaline substances such as lime. Frequently, sodium hydroxide, sodium carbonate, sulfides or organosulfur compounds are likewise added. In the fleshing step, flesh residues and subcutaneous adipose tissue are removed from the animal hide, mechanically for example. In the deliming step, the alkaline components from the unhairing step are partially or completely neutralized. In bating, the animal hide is loosened up and readied for the absorption of the tanning agent and hence for the actual tanning step. When a mineral tannage is to be carried out subsequently, the pelt is brought to the correct acidity for tanning by pickling, usually with inorganic acids and brine, optionally also with additions of organic acids. Hair roots, hair pigments, short-hair and fatty substances remaining in the epidermis are often impossible to remove by washing off or rinsing alone. Therefore, a scudding step is carried out, particularly in artisanal facilities, where, for example, a scudding knife is applied to the hides on a tanner's beam.

The actual tanning steps take place in the presence of a tanning agent. Suitable tanning processes comprise the use of mineral salts (chromium(III), aluminum, zirconium or iron salts), vegetable tanning with vegetable tanning agents (tannins in leaves, bark, woods and fruit), oil tannage (interchangeably also known as chamois tannage) with fish and marine-animal oils (train oils) or with brain fats, synthetic tannage with synthetically produced tanning agents (syntans, resin type tanning agents, polymer type tanning agents, polyphosphates, paraffin sulfochloride), aldehyde tannage (formerly formaldehyde, now mainly glutaraldehyde). It is also possible to combine various tanning processes.

After tanning, the leather is generally dewatered mechanically (by sammying) and shaved to a uniform thickness.

Especially in chrome tannage and in the production of chromium-free leathers by a combined pretannage with aldehydes and synthetic tanning agents, the final properties of the leather such as softness, color, fullness, texture, extensibility, water absorbence, etc., are determined by the wet-on-wet finish.

Further operations frequently include retanning, deacidifying or neutralization, dyeing, fatliquoring and fixing the dye and fatliquor materials. Retanning can in principle be carried out with any of the groups of tanning materials which were described in connection with the principal tannage. But particular significance in retanning is possessed by synthetic tanning materials, vegetable-type tanning materials and resin and polymer-type tanning materials, since these frequently have a particularly favorable effect on the fullness and texture of the leather.

The deacidifying step frequently comprises neutralizing the residues of strong acids, which generally results in better stability for the leather.

Dyeing is frequently carried out with dyes which form a chemical bond with the leather fiber. Many dyes possess not only good dyeing properties (for example: affinity for leather, compatibility, wide color gamut) and fastnesses but also minimal impact on the environment. The natural color of leather depends inter alia on the tanning agent used. Chrome tannages frequently produce a light grayish green color, while vegetable-tanned leathers can be, for example, yellowish brown or reddish brown. Aluminum salts and synthetic tanning materials frequently produce white to pale beige leathers. Glutaraldehyde and oil type tanning agents generally dye the leathers yellowish.

Fatliquoring imparts better softness and suppleness. Fatliquoring agents enclose the leather fibers with a thin film of fat. As a result, the fibers do not stick together as much during drying and can slide over each other more easily. Fatliquoring is generally preceded by a pH of 4 to 6.5 being set, preferably a pH in the range from 4.5 to 6. A more acidic pH is set during the fatliquoring step, in particular at the end of the fatliquoring step, in order that uniform fixing of the fatliquoring agent may be achieved throughout the leather cross section. In general, the pH set at the end of the fatliquoring step is in the range from 2 to 6 preferably 2.5 to 5, more preferably in the range from 3 to 4 and even more preferably in the range from 3.2 to 3.5. Hydrophobicizing agents can be used to render leathers dirt and water repellent, or waterproof.

The abovementioned steps are frequently carried out in the stated order in the manufacturing operation. However, within limits it is also possible to carry them out in different orders or for steps to be carried out conjointly and combined.

The aforementioned steps do not all have to be carried out to produce leather. In addition, methods of producing leather may also include further steps in addition to the aforementioned steps.

The present invention is that methanesulfonic acid is used in at least one of the steps for production of leather. The methanesulfonic acid serves primarily to set the pH. The methanesulfonic acid is preferably added to the animal hide at the start of the actual operation. In the case of deliming, the operation consists essentially in neutralizing alkaline components with acids which, according to the present invention, comprise methanesulfonic acid. For the purposes of the present invention, the use of methanesulfonic acid in a specified operation is to be understood as also encompassing the addition of methanesulfonic acid before the actual operation or after the preceding operation when the latter is preparatory for the actual operation.

Methanesulfonic acid is preferably used in one of the following steps: deliming, bating, pickling, scudding, tanning, retanning, dyeing, fatliquoring.

Methanesulfonic acid is more preferably used at least in deliming and/or bating and/or pickling and/or fatliquoring.

In a preferred embodiment, methanesulfonic acid is used in the deliming step at least.

In another preferred embodiment, methanesulfonic acid is used in the fatliquoring step at least.

Methanesulfonic acid in the present invention is generally employed in the form of an aqueous solution. Methanesulfonic acid is generally used in the form of a 0.05 to 0.5 wt % aqueous solution, preferably in the form of a 0.07 to 0.2 wt % aqueous solution and more preferably in the form of a 0.08 to 0.15 wt % aqueous solution.

In one embodiment, methanesulfonic acid is used together with salts and/or other acids and/or acid derivatives. Suitable acid derivatives include, for example, esters or acid anhydrides.

In one embodiment, methanesulfonic acid is employed together with salts of methanesulfonic acid. Suitable salts of methanesulfonic acid include, for example, alkali or alkaline earth metal salts such as, for example, sodium, potassium, magnesium or calcium salts of methanesulfonic acid.

In another embodiment, methanesulfonic acid is employed together with inorganic salts. Suitable inorganic salts include, for example, salts of sulfuric acid, halohydric acids, phosphoric acid, boric acid, carbonic acid, nitric acid. Examples of suitable inorganic salts include, for example, ammonium sulfate, sodium sulfate, sodium chloride, ammonium chloride.

In another embodiment, methanesulfonic acid is employed together with salts of organic acids. Suitable salts of organic acids include, for example, ammonium, alkali metal or alkaline earth metal salts of organic acids such as ammonium, sodium, potassium or magnesium salts of organic acids. Suitable salts of organic acids include, for example, salts of monocarboxylic acids or dicarboxylic acids. Examples of suitable salts of organic acids are, for example, salts of formic acid, acetic acid, propionic acid, oxalic acid, malonic acid, succinic acid, glutaric acid, adipic acid, tartaric acid, lactic acid, phthalic acid, terephthalic acid, maleic acid, fumaric acid. In another embodiment, methanesulfonic acid is employed together with other acids. Suitable other acids can be organic acids or inorganic acids. Suitable inorganic acids include, for example, sulfuric acid, hydrochloric acid, boric acid, carbonic acid, phosphoric acid. Suitable organic acids include, for example, monocarboxylic acids or dicarboxylic acids. Examples of suitable organic acids are formic acid, acetic acid, lactic acid, formic acid, propionic acid, oxalic acid, malonic acid, succinic acid, glutaric acid, adipic acid, tartaric acid, lactic acid, phthalic acid, terephthalic acid, maleic acid, fumaric acid.

In one embodiment, methanesulfonic acid is employed in combination with ammonium sulfate.

In another embodiment, methanesulfonic acid is employed in combination with formic acid.

In another embodiment, methanesulfonic acid is employed in combination with one or more ammonium salts of dicarboxylic acids.

In another embodiment, methanesulfonic acid is employed in combination with one or more aliphatic dicarboxylic acids.

In another embodiment, methanesulfonic acid is employed in combination with one or more carboxylic esters.

The amount of salts, other acids or acid derivatives can vary within wide limits. In one embodiment, an aqueous solution comprising from 0.05 to 0.2 wt % of methanesulfonic acid and 0.5 to 2 wt % of ammonium sulfate is employed.

A pH of 4 to 9, preferably 6 to 8.5 and more preferably 7.5 to 8.5 is typically set in the deliming step of the method according to the present invention.

The deliming step generally takes from 30 minutes to 4 hours but may in exceptional cases also take longer or less time. The deliming step is preferably concluded within 45 to 90 minutes.

Methods of the present invention are simple to carry out and enable efficient and rapid pH setting in their individual steps.

Methods of the present invention further make possible the production of leathers having advantageous visual and haptic properties. They are more particularly notable inter alia for pleasant softness and do not swell up as much, do not bulge up as much as leathers obtained according to conventional methods.

The leathers obtained according to the present invention are notable for good softness and have a pleasant, attractive, fine and clean grain pattern. They are also notable for good dyeing properties such as high uniformity and color brightness.

The physical properties such as tensile strength, tear strength, elongation at break or grain extensibility of leathers obtained according to the method of the present invention are comparable or superior to those of leathers obtained according to the prior art.

In particular, leather obtained according to the present invention by using methanesulfonic acid in the deliming step, in addition to the advantages described above, is notable in that calcium ions are very efficiently removable from the leather. This has an advantageous influence on leather tear strength and softness in particular.

Leather obtained according to the present invention by using methanesulfonic acid in the fatliquoring step, in addition to having the above-described advantages, is notable in that, if it is chrome-tanned leather, only minimal amounts of chromium compounds are washed out of the leather.

The present invention further provides leather obtained according to the method of the present invention.

EXAMPLES

The invention is further explicated by working examples.

Abbreviations Used:

Decaltal® RN: acid-reacting mixture of ammonium salts of inorganic acids and of organic dicarboxylic acids Decaltal® Pic S: mixture of weak water-soluble aliphatic dicarboxylic acids Decaltal® ESN: liquid mixture of carboxylic esters

Examples I.1 to I.6

A raw cattlehide was unhaired and fleshed. Unhairing was accomplished by addition of burnt lime and sodium sulfide. For deliming, the leathers were treated with deliming agent as per Examples I.1 to I.6 in order to establish a pH of 8. In the deliming step, the hides were initially treated at room temperature with a mixture A for 20 minutes and then with a mixture B for 60 minutes. The hides were subsequently subjected to tanning and retanning with identical chrome tannage formulations.

Example I.1 mixture A: aqueous solution comprising 0.1 wt % of sodium hydrogensulfite and 0.5 wt % of ammonium sulfate.

mixture B: aqueous solution comprising 0.1 wt % of sodium hydrogensulfite, 0.14 wt % of methanesulfonic acid (70 wt % in water) and 1.5 wt % of an acid-reacting mixture of Decaltal® RN.

Example I.2 mixture A: aqueous solution comprising 0.1 wt % of sodium hydrogensulfite and 0.5 wt % of ammonium sulfate.

mixture B: aqueous solution comprising 0.1 wt % of sodium hydrogensulfite and 0.3 wt % of Decaltal® Pic S and 1.5 wt % of ammonium sulfate.

Example I.3 mixture A: aqueous solution comprising 0.1 wt % of sodium hydrogensulfite and 0.5 wt % of Decaltal® RN.

mixture B: aqueous solution comprising 0.1 wt % of sodium hydrogensulfite, 0.14 wt % of methanesulfonic acid (70 wt % in water) and 1.5 wt % of Decaltal® RN.

Example I.4 mixture A: aqueous solution comprising 0.1 wt % of sodium hydrogensulfite and 0.5 wt % of Decaltal® RN.

mixture B: aqueous solution comprising 0.1 wt % of sodium hydrogensulfite, 0.3 wt % of methanesulfonic acid (70 wt % in water) and 1.5 wt % of Decaltal® RN.

Example I.5 mixture A: aqueous solution comprising 0.1 wt % of sodium hydrogensulfite and 0.14 wt % of methanesulfonic acid (70 wt % in water).

mixture B: aqueous solution comprising 0.1 wt % of sodium hydrogensulfite, 0.14 wt % of methanesulfonic acid (70 wt % in water) and 1.2 wt % of Decaltal® ESN.

Example I.6 mixture A: aqueous solution comprising 0.1 wt % of sodium hydrogensulfite and 0.25 wt % of Decaltal® Pic S.

mixture B: aqueous solution comprising 0.1 wt % of sodium hydrogensulfite, 0.25 wt % of Decaltal® Pic S and 1.2 wt % of Decaltal® ESN.

The use of methanesulfonic acid made it possible to establish the pH within a shorter period and yielded clean and flat rawhides which were not swollen up as much as hides delimed without methanesulfonic acid.

The leathers obtained by using methanesulfonic acid in the deliming step are softer than leathers obtained as per the prior art, and they have attractive, fine and clean grain patterns. The physical properties are comparable or superior to those of leathers obtained as per the prior art.

Example II.1

Four pieces of a raw cattlehide were unhaired and fleshed. Unhairing was accomplished by addition of burnt lime and sodium sulfide. For deliming, the hides were initially washed at room temperature with water for 20 minutes and then admixed with a 1.2 wt % solution of ammonium sulfate initially and then with a 3.5 wt % solution of ammonium sulfate and left to soak for 10 minutes to establish a pH of 8.3 to 8.5.

Example II.2

Two pieces of the rawhide from Example II.1 were then admixed with an aqueous solution comprising 0.6 wt % of methanesulfonic acid to establish a pH of 8.3

The aqueous solutions of Examples II.1 and II.2 were measured for their pH and calcium ion content after 10, 20, 40, 80 and 140 minutes. The results are reported in Table 1.

TABLE 1 pH and calcium ion concentration in ppm in the deliming solution of Examples II.1 and II.2, $Ca^{2+}$ concentration determined via atomic emission spectroscopy

| t [min] | 10 | 20 | 40 | 80 | 140 |
|---|---|---|---|---|---|
| pH Example II.1 | 8.4 | 8.55 | 8.55 | 8.45 | 8.43 |
| pH Example II.2 | 9.0 | 8.13 | 8.38 | 8.35 | 8.3 |
| [Ca2+], Example II.1 [ppm] | 450 | 475 | 525 | 530 | 550 |
| [Ca2+], Example II.2 [ppm] | 415 | 620 | 610 | 700 | 700 |

The pH of the deliming solutions in Examples II.1 and II.2 was in both cases between 8.3 and 8.43, and was very similar.

The content level of free calcium ions in the deliming solution of Examples II.1 and II.2 was distinctly higher with addition of methanesulfonic acid than without addition of methanesulfonic acid.

Example II.3

Determination of Calcium Content of Leather

The subsequent method was carried out on different pieces before starting the deliming process and also after concluding the deliming process.

The leathers of Examples II.1 and II.2 were dried before starting and after concluding the deliming, respectively. 0.15 g of leather was placed in a 50 ml conical flask and 4 ml of a mixture of nitric acid and hydrochloric acid (mass ratio 1.3) were added. As soon as the mixture had cooled back down to room temperature, 1 ml of hydrogen peroxide (32 wt % in water) was added thereto. The mixture was heated to 120° C. for 180 min. The mixture was cooled down to room temperature and made up to 50 ml with water. The content level of calcium ions in the leather was determined by determining the concentration of calcium ions in the solution by atomic absorption spectroscopy.

It transpired that the proportion of calcium removed from the leather was 29% on using ammonium sulfate as neutralizing agent and 52% on using ammonium sulfate and methanesulfonic acid.

Example II.4

The leathers of Examples II.1 and II.2 were washed twice with water for 10 minutes. The hides were then subjected to tanning and retanning with identical chrome tannage formulations. The leathers of Example II.2 (with addition of methanesulfonic acid) were less swollen and softer than the leathers of Example II.1 (without methanesulfonic acid).

Example III

Chrome-tanned wet-blue leather (cattle) was cut into pieces 1×1 cm in size and 25 g at a time were introduced into a 250 ml glass flask. In each case 5 g of fatliquoring agent as per Table 2 were added and also in each case sufficient completely ion-free (CIF) water for the amount of liquid in the flask including the fatliquoring agent to be 75 ml. The flasks were heated to 40° C. for three hours.

The mixtures thus obtained were adjusted in accordance with Table 2 to various pH values using formic acid or methanesulfonic acid. The mixtures thus obtained were heated to 40° C. for three hours. Of the mixtures thus obtained, a sample of the supernatant solution was taken and measured by atomic absorption spectroscopy for its content of chromium salts.

The results are reported in Table 2.

TABLE 2

Chromium content of wastewater from various wet-blue leathers on addition of formic acid or MSA in the fatliquoring step; fatliquoring agents used: SS: sulfonated rapeseed oil, SIM: sulfite fish oil, OSL: sulfite fish oil, SXL/N: combined fatliquoring agent, sulfate/castor oil; amount particulars of acid in wt % relative to leather used.

| Fatliquoring agent | Formic acid/% | pH | Chromium content (mg/L) | MSA/% | pH | Chromium content (mg/L) |
|---|---|---|---|---|---|---|
| SIM | 0.6 | 4.79 | 37 | 0.5 | 4.9 | 15.6 |
| | 0.8 | 4.21 | 44.4 | 0.9 | 4.08 | 18.7 |
| | 1.0 | 3.77 | 49.7 | 1.1 | 3.79 | 20.4 |
| SXL/N | 0.6 | 4.64 | 29.2 | 0.6 | 4.73 | 11.2 |
| | 0.8 | 4.31 | 36.2 | 0.9 | 3.94 | 16 |
| | 1.0 | 3.87 | 48.3 | 1.1 | 3.66 | 19.2 |

TABLE 2-continued

Chromium content of wastewater from various wet-blue leathers on addition of formic acid or MSA in the fatliquoring step; fatliquoring agents used: SS: sulfonated rapeseed oil, SIM: sulfite fish oil, OSL: sulfite fish oil, SXL/N: combined fatliquoring agent, sulfate/castor oil; amount particulars of acid in wt % relative to leather used.

| Fatliquoring agent | Formic acid/% | pH | Chromium content (mg/L) | MSA/% | pH | Chromium content (mg/L) |
|---|---|---|---|---|---|---|
| SS | 0.7 | 4.89 | 20 | 0.8 | 4.13 | 10.3 |
| | 0.9 | 4.02 | 21.2 | 0.9 | 3.68 | 13.9 |
| | 1.1 | 3.81 | 25.3 | 1.1 | 3.36 | 14.5 |
| OSL | 0.6 | 4.91 | 40.9 | 0.7 | 4.36 | 18.1 |
| | 0.8 | 4.03 | 52.5 | 0.9 | 3.96 | 23.6 |
| | 1.0 | 3.59 | 55 | 1.1 | 3.7 | 24.3 |
| sulfated | 0.8 | 4.8 | 8.6 | 0.7 | 4.67 | 6 |
| castor | 1.0 | 4.24 | 10.9 | 1.0 | 3.97 | 6.4 |
| oil | 1.2 | 3.9 | 15.1 | 1.2 | 3.66 | 7 |
| no fat- | 0.6 | 4.94 | 1.42 | 0.7 | 3.89 | 1.65 |
| liquoring | 0.8 | 4.16 | 17.79 | 0.9 | 3.57 | 3.33 |
| agent | 1.2 | 3.74 | 37.03 | 1.1 | 3.04 | 4.94 |

At the same pH, distinctly less chromium is washed out of leather in the presence of MSA than in the presence of formic acid.

We claim:

1. A method of producing soft leather, the process comprising:

performing a deliming operation of an animal hide in an aqueous deliming solution having a pH of from 7.5 to 8.5, the deliming solution comprising:

from 0.05 to 0.5 wt. % methanesulfonic acid, sodium hydrogensulfite;

from 0.5 to 2 wt % of ammonium sulfate, and from 0.6 to 1.0 wt. % of formic acid;

for at least 20 minutes to remove calcium ions from the animal hide and increase a free calcium ions concentration in the deliming aqueous solution.

2. The method of claim 1, wherein methanesulfonic acid is used in the form of a mixture comprising a salt and/or another acid and/or an acid derivative.

3. The method of claim 1, wherein the leather is chrome-tanned leather.

4. The method of claim 1, wherein in the deliming operation the methanesulfonic acid is added in the amount of from 0.07 to 0.2 wt. % of the aqueous deliming solution.

5. The method of claim 1, wherein an ammonium salt of a dicarboxylic acid is further added to the aqueous deliming solution in the deliming operation.

6. The method of claim 1, wherein an aliphatic dicarboxylic acid is further added to the aqueous deliming solution in the deliming operation.

7. The method of claim 1, wherein a carboxylic ester is further added to the aqueous deliming solution in the deliming operation.

8. The method of claim 1, wherein the aqueous deliming solution comprises from 0.05 to 0.2 wt % of the methanesulfonic acid, in the deliming operation.

9. The method of claim 1, wherein the deliming operation is performed for 30 minutes to 4 hours.

* * * * *